US008168360B2

(12) United States Patent
Ino et al.

(10) Patent No.: US 8,168,360 B2
(45) Date of Patent: May 1, 2012

(54) EXTERNAL ADDITIVE, TONER, AND IMAGE FORMING APPARATUS

(75) Inventors: Toshiaki Ino, Soraku-gun (JP); Shinya Mimura, Nara (JP); Yasuhiro Nishimura, Takaishi (JP)

(73) Assignee: Sharp Kabushiki Kaisha, Osaka (JP)

( * ) Notice: Subject to any disclaimer, the term of this patent is extended or adjusted under 35 U.S.C. 154(b) by 958 days.

(21) Appl. No.: 12/173,891

(22) Filed: Jul. 16, 2008

(65) Prior Publication Data

US 2009/0022519 A1 Jan. 22, 2009

(30) Foreign Application Priority Data

Jul. 20, 2007 (JP) ..... 2007-190107

(51) Int. Cl.
*G03G 9/08* (2006.01)

(52) U.S. Cl. ..... 430/108.3; 399/252

(58) Field of Classification Search ..... 430/108.3; 399/252

See application file for complete search history.

(56) References Cited

U.S. PATENT DOCUMENTS

| | | | | |
|---|---|---|---|---|
| 5,447,815 | A | 9/1995 | Kato et al. | |
| 5,532,798 | A | 7/1996 | Nakagami et al. | |
| 2005/0203214 | A1 | 9/2005 | Amano et al. | |
| 2005/0244642 | A1 | 11/2005 | Meyer et al. | |
| 2006/0029436 | A1 * | 2/2006 | Toyoda et al. | 399/279 |

FOREIGN PATENT DOCUMENTS

| | | | |
|---|---|---|---|
| JP | 6-51554 | A | 2/1994 |
| JP | 7-64318 | A | 3/1995 |
| JP | 2002-278224 | A | 9/2002 |
| WO | 2004/020532 | | 3/2004 |

* cited by examiner

*Primary Examiner* — Mark A Chapman
(74) *Attorney, Agent, or Firm* — Nixon & Vanderhye P.C.

(57) ABSTRACT

To a toner used in an image forming apparatus is added an external additive whose main components are oxide fine particles in which dimethylsilyl groups are introduced to surfaces thereof, and whose volatilizing amount of octamethylcyclotetrasiloxane in a first volatilizing test is 0.2 μg or less. Consequently, it is possible to prevent foreign matters from attaching to a discharging electrode included in the image forming apparatus. The first volatilizing test is performed in such a manner that 2 g of the external additive is put in a sealing container and the inside of the sealing container is kept at 120° C. for 10 minutes so that octamethylcyclotetrasiloxane volatilizes from the external additive.

14 Claims, 5 Drawing Sheets

EXTERNAL ADDITIVE, TONER, AND IMAGE FORMING APPARATUS

This Nonprovisional application claims priority under U.S.C. §119(a) on Patent Application No. 2007-190107 filed in Japan on Jul. 20, 2007, the entire contents of which are hereby incorporated by reference.

FIELD OF THE INVENTION

The present invention relates to a toner used in an electrophotographic image forming apparatus and an external additive contained in the toner.

BACKGROUND OF THE INVENTION

An image forming process performed in an electrophotographic image forming apparatus generally includes the steps of charging, exposing, developing, transferring, detaching, cleaning, charge removing, and fixing. In the step of charging, the surface of a photosensitive drum driven to rotate is charged evenly by a charging device. In the step of exposing, laser light is emitted onto the surface of the charged photosensitive drum so as to form an electrostatic latent image thereon. In the step of developing, a toner is electrostatically attached to the electrostatic latent image on the photosensitive drum so as to develop a toner image, thereby forming a toner image on the surface of the photosensitive drum. In the step of transferring, the toner image on the surface of the photosensitive drum is transferred by a transferring device onto a sheet. In the step of fixing, the toner image transferred onto the sheet is fixed to the sheet by a heating and fixing device. In the step of detaching, the sheet is detached from a heating roller of the heating and fixing device. In the step of cleaning, a toner remaining on the surface of the photosensitive drum is removed by a cleaning device and is recovered to a predetermined recovering section. In the step of charge removing, electric charges remaining on the surface of the photosensitive drum after the remaining toner has been removed is removed so as to prepare for a next image forming process.

In general, the photosensitive drum is a drum around which an organic photoconductor is applied as an optical conductive layer. A corona charger is widely used as the charging device for applying electric charges on the surface of the photosensitive drum. Examples of the corona charger include a wire corona charger and a sawtooth corona charger.

The wire corona charger includes a very thin conductive tungsten wire (discharging electrode) and a conductive shield case for covering portions other than an end of the tungsten wire (a portion facing the photosensitive drum). Application of a high voltage to the tungsten wire causes discharge from the tungsten wire to the photosensitive drum, so that the photosensitive drum is charged.

The sawtooth corona charger is provided with a sawtooth electrode (discharging electrode) including a plurality of acuminate protrusions and having a plate-like shape. The sawtooth corona charger discharges from the sawtooth electrode to the photosensitive drum, so that the photosensitive drum is charged.

The wire corona charger and the sawtooth corona charger can be used not only for charging the photosensitive drum but also for a charge removing device, a transfer device etc.

In the corona charger, when foreign matters attach to the discharging electrode, a portion to which the foreign matters attach drops its discharging performance. Consequently, the photosensitive drum cannot be evenly charged and charge unevenness occurs. The charge unevenness causes image defections such as black streaks on an obtained image. In order to solve the problem, Patent Citation 1 proposes a technique in which a cleaning roller for cleaning a discharging electrode is provided so as to remove foreign matters attached to the discharging electrode.

(Patent Citation 1)

Japanese Unexamined Patent Publication No. Tokukaihei 7-43990 (published on Feb. 14, 1995)

The technique proposed in Patent Citation 1 is effective for removing the foreign matters attached to the discharging electrode. However, the technique does not prevent a phenomenon that foreign matters attach to the discharging electrode. Therefore, in order to always assure a high-quality image with use of the technique of Patent Citation 1, it is necessary to frequently drive the cleaning roller. While driving the cleaning roller, printing cannot be performed. Consequently, performance of a printing device drops.

In consideration of the above, it is considered as follows: in order to prevent the image defects, it is more desirable to prevent attachment of foreign matters to the discharging electrode than to clean foreign matters attached to the discharging electrode as in Patent Citation 1.

SUMMARY OF THE INVENTION

An object of the present invention is to obtain a high-quality image by preventing attachment of foreign matters to a discharging electrode included in an electrophotographic image forming apparatus.

The inventors of the present invention diligently studied the cause of attachment of foreign matters to a discharging electrode of a charger, and considered the cause to be as follows.

In an external additive included in a toner, dimethylsilyl groups are introduced to the surfaces of particles (the surfaces of particles are subjected to a hydrophobizing process) in order to prevent photographic fog on an image when forming the image. In the hydrophobizing process, octamethylcyclotetrasiloxane is produced (in some cases, a coupling agent for the hydrophobizing process contains octamethylcyclotetrasiloxane).

It is supposed that octamethylcyclotetrasiloxane remains in the external additive in such a manner as to be attached to the surface of the external additive. When a toner including the external additive to which octamethylcyclotetrasiloxane is attached is used in an image forming apparatus, octamethylcyclotetrasiloxane volatilizes gradually from the toner and attaches to the discharging electrode of the charger. Thereafter, octamethylcyclotetrasiloxane at the discharging electrode chemically changes to a non-volatile silicon compound, which attaches to the discharging electrode as foreign matters.

With respect to the problem, the inventors of the present invention found that even in a case where a main component of an external additive is oxide fine particles in which dimethylsilyl groups are introduced to surfaces thereof, when the amount of octamethylcyclotetrasiloxane volatilizing in a later-mentioned first volatilizing test on the external additive is 0.2 μg or less, octamethylcyclotetrasiloxane hardly volatilizes from the external additive when performing an image forming process with use of the toner containing the external additive. Thus, the inventors completed the present invention.

That is, the present invention is an external additive, containing oxide fine particles as a main component, added to a toner used in an electrophotographic image forming apparatus, dimethylsilyl groups being introduced to surfaces of the oxide fine particles, and an amount of octamethylcyclotetrasiloxane volatilizing in a first volatilizing test being 0.2 μg or less. With the arrangement, as described above, octamethylcyclotetrasiloxane hardly volatilizes from the external additive when performing the image forming process. Consequently, it is possible to prevent foreign matters from attaching to a discharging electrode, resulting in a high-quality image without black streaks.

The first volatilizing test is a test in which 2 g of the external additive is contained in a sealing container and the inside of the sealing container is kept at 120° C. for 10 minutes so that octamethylcyclotetrasiloxane volatilizes from the external additive.

The inventors of the present invention found that even in a case of using a toner containing an external additive whose main component is oxide fine particles in which dimethylsilyl groups are introduced to surfaces thereof, when the amount of octamethylcyclotetrasiloxane volatilizing in a later-mentioned second volatilizing test on the toner is 0.02 μg or less, octamethylcyclotetrasiloxane hardly volatilizes from the external additive when performing an image forming process with use of the toner containing the external additive.

That is, the present invention is a toner, containing an external additive that contains oxide fine particles as a main component, used in an electrophotographic image forming apparatus, dimethylsilyl groups being introduced to surfaces of the oxide fine particles, and the amount of octamethylcyclotetrasiloxane volatilizing in a second volatilizing test being 0.02 μg or less. With the arrangement, as described above, octamethylcyclotetrasiloxane hardly volatilizes from the toner when performing the image forming process. Consequently, it is possible to prevent foreign matters from attaching to a discharging electrode, resulting in a high-quality image without black streaks.

The second volatilizing test is a test in which 10 g of the toner is contained in a sealing container and the inside of the sealing container is kept at 100° C. for 30 minutes so that octamethylcyclotetrasiloxane volatilizes from the external additive.

Additional objects, features, and strengths of the present invention will be made clear by the description below. Further, the advantages of the present invention will be evident from the following explanation in reference to the drawings.

DESCRIPTION OF THE EMBODIMENTS

Prior to explanations of an embodiment of an external additive of the present invention for toner use and of an embodiment of a toner of the present invention, the following explains an image forming apparatus in which the toner of the present embodiment is used.

[Image Forming Apparatus]

Figure 1:
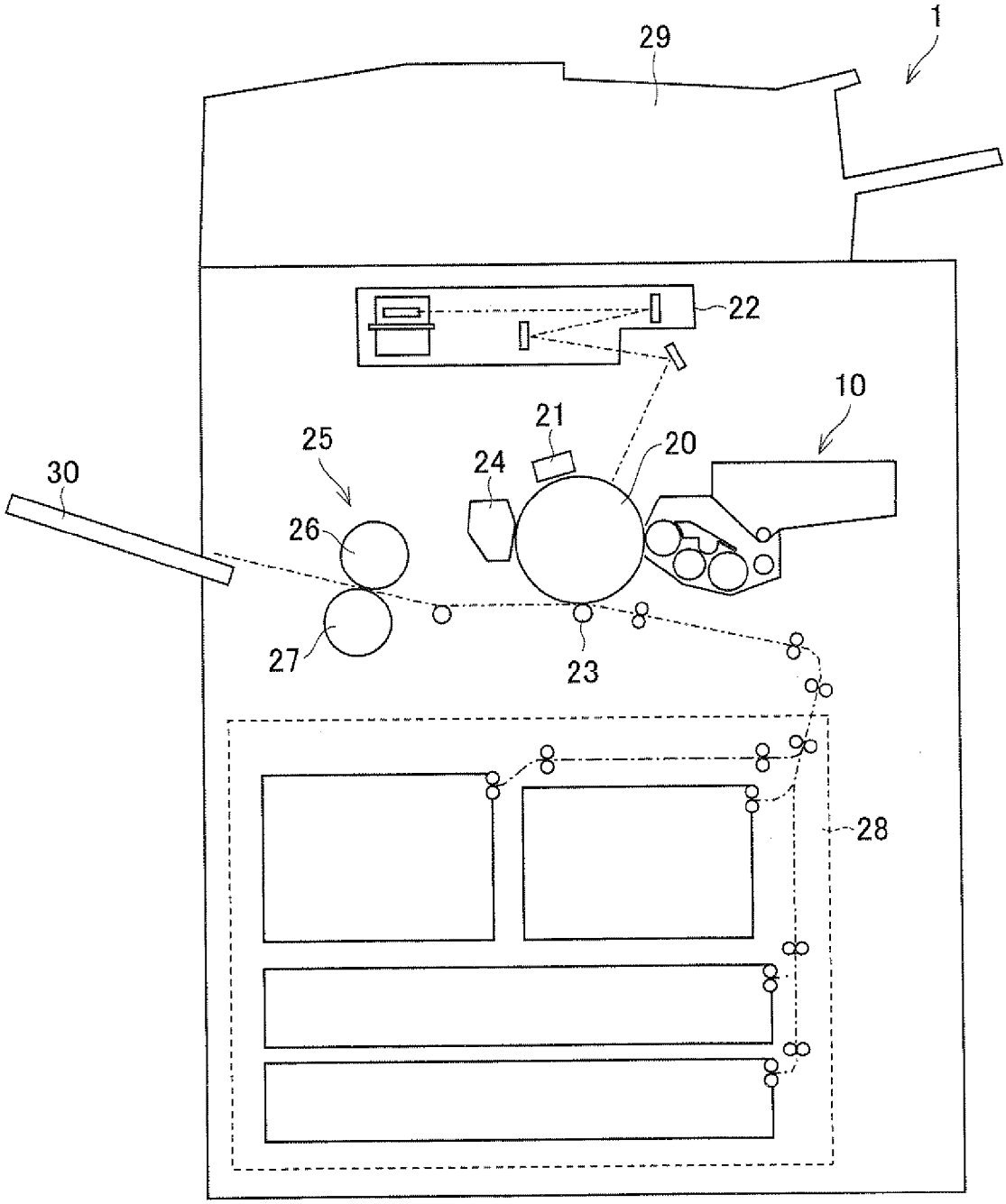
FIG. 1 is a drawing schematically illustrating an arrangement of an image forming apparatus in which a toner of an embodiment of the present invention is used.

FIG. 1 is a drawing schematically illustrating an arrangement of an image forming apparatus 1 of the present embodiment. The image forming apparatus 1 is a digital multifunction printer and realizes a copy mode and a printing mode. The copy mode is a mode in which the image forming apparatus 1 causes a scanner section 29 to read an image of a document and prints the image on a recording material such as a sheet. The printing mode is a mode in which the image forming apparatus 1 prints on a recording material an image indicated by image information transmitted from an external device connected with the image forming apparatus 1 via a network.

As illustrated in FIG. 1, the image forming apparatus 1 includes a photosensitive drum 20, a corona charger 21, an exposing device 22, a developing device 10, a transferring device 23, a fixing device 25, a cleaning device 24, paper feeding trays 28 a scanner section 29, and a paper output tray 30. The following sequentially explains these members.

In the image forming apparatus 1, an image is printed as follows. First, the corona charger 21 evenly charges the surface of the photosensitive drum 20 that is driven to rotate. The exposing device 22 emits laser light onto the surface of the charged photosensitive drum 20 so as to form an electrostatic latent image. Then, the developing device 10 electrostatically attaches a toner onto the electrostatic latent image on the surface of the photosensitive drum 20 so as to develop and form a toner image on the surface of the photosensitive drum 20. Then, the transferring device 23 transfers the toner image on the surface of the photosensitive drum 20 onto a recording medium. After the transfer, the cleaning device 24 removes a toner remaining on the photosensitive drum 20. The fixing device 25 fixes the toner image on the recording medium. Thus, printing of an image is completed.

The following explains members included in the image forming apparatus 1 in more detail.

[Photosensitive Drum]

The photosensitive drum 20 is a roller-like member that is supported to be driven by driving means (not shown) to rotate around the axis of the photosensitive drum 20. The photosensitive drum 20 has on its surface a photosensitive film on which an electrostatic latent image, furthermore a toner image, is formed. The photosensitive drum 20 may be a roller-like material including a conductive base material (not shown) and a photosensitive film (not shown) formed on the surface of the conductive base material. The conductive base material may have a shape such as a hollow cylinder shape, a solid cylinder shape, and a sheet shape. Among them, a hollow cylinder shape is preferable. Examples of the photosensitive film include an organic photosensitive film and an inorganic photosensitive film.

Examples of the organic photosensitive film include: a laminate in which an electric charge generating layer that is a resin layer containing an electric-charge-generating substance and an electric charge transferring layer that is a resin layer containing an electric-charge-transferring-substance are laminated; and a single resin layer containing an electric-charge-generating substance and an electric-charge-transferring substance. An example of the inorganic photosensitive film is a film containing one or more substances selected from zinc oxide, selenium, amorphous silicon, etc. An underlying layer may be provided between the conductive base material and the photosensitive film. A surface film (protective film)

for protecting the photosensitive film may be provided on the surface of the photosensitive film.

[Developing Device]

Figure 2:
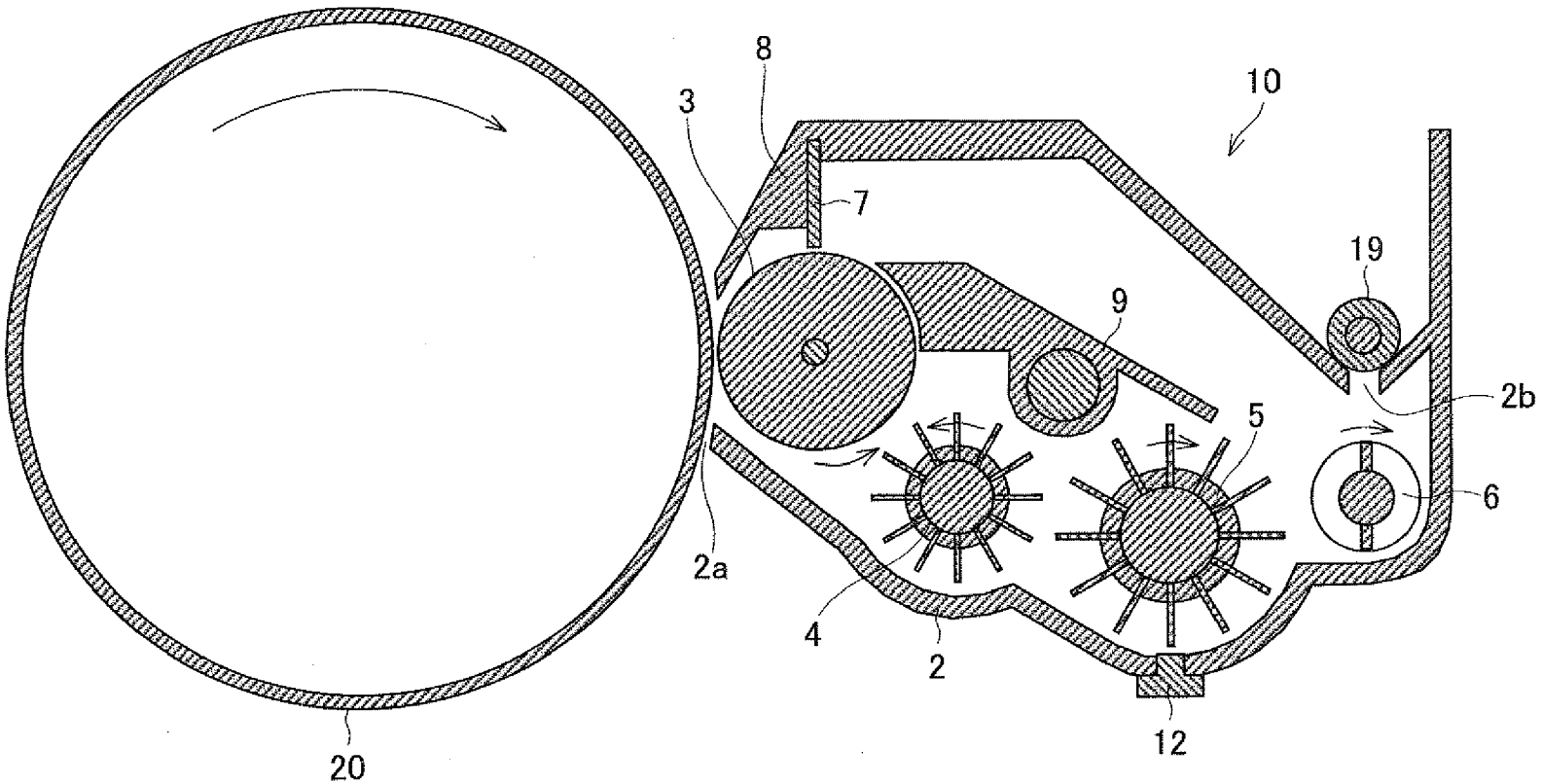
FIG. 2 is a drawing schematically illustrating an arrangement of a developing device included in the image forming apparatus illustrated in FIG. 1.

FIG. 2 is a drawing schematically illustrating an internal structure of the developing device 10 illustrated in FIG. 1. The developing device 10 includes a developing tank 2, a developing roller 3, a first stirring member 4, a second stirring member 5, a transferring member 6, a regulating member 7, a regulating member supporter 8, a flowing plate 9, and a toner concentration detecting sensor 12.

The developing tank 2 is a substantially rectangular-column-shaped housing having a space therein. The developing tank 2 supports the developing roller 3, the first stirring member 4, the second stirring member 5, and the transferring member 6 in such a manner that these members are rotatable. The developing tank 2 directly or indirectly supports the regulating member 7, the flowing plate 9, etc. The developing tank 2 contains developer. The developing tank 2 has an opening 2*a* that faces the photosensitive drum 20. The developing tank 2 has a toner supply opening 2*b* on its upper surface.

A toner cartridge (not shown) and a toner hopper (not shown) are provided above the developing tank 2 (in a direction opposite to a plumb-bob direction of the developing tank 2). More specifically, from above to below (plumb-bob direction), the toner cartridge, the toner hopper, and the developing tank 2 are provided in this order. The toner cartridge contains a toner therein, and is provided in the main body of the image forming apparatus 1 in such a manner as to be detachable from the main body.

The toner cartridge is a hollow cylindrical member and is driven by driving means (not shown) in the image forming apparatus 1 to rotate around the axis of the hollow cylinder. On the outer surface of the toner cartridge is formed a long slit extending in an axis direction. As the toner cartridge rotates, a toner drops from the slit and is supplied to the toner hopper. The toner hopper is provided in such a manner that a toner feeding opening for receiving the toner dropping from the toner cartridge and the toner supply opening 2*b* provided above the developing tank 2 communicate with each other. In the toner hopper, a toner supply roller 19 is provided above the toner supply opening 2*b*. The toner supply roller 19 is supported by the toner hopper to be rotatable, and is driven by driving means (not shown) to rotate around the axis of the toner supply roller 19. The performance of the toner supply roller 19 is controlled by control means (not shown) in the image forming apparatus 1 in accordance with the result of the toner concentration detecting sensor 12 detecting toner concentration in the developing tank 2. As a result of rotation of the toner supply roller 19, a toner is supplied into the developing tank 2 via the toner feeding opening and the toner supply opening 2*b*.

The developing roller 3 is supported by the developing tank 2 and is driven by driving means (not shown) to rotate around the axis of the developing roller 3. The developing roller 3 is provided to face the photosensitive drum 20 via the opening 2*a* of the developing tank 2. Further, the developing roller 3 is provided to have a certain distance from the photosensitive drum 20. A gap between the developing roller 3 and the photosensitive drum 20 is referred to as a developing nip section.

At the developing nip section, a toner is supplied from a developer layer (not shown) on the surface of the developing roller 3 to an electrostatic latent image on the surface of the photosensitive drum 20. At the developing nip section, a developing bias voltage is applied from a power source (not shown) connected with the developing roller 3 to the developing roller 3, allowing a toner to be smoothly transferred from the developer layer on the surface of the developing roller 3 to the electrostatic latent image on the surface of the photosensitive drum 20. In the present embodiment, the developing roller 3 rotates counterclockwise in FIG. 2, and the photosensitive drum 20 rotates clockwise in FIG. 2.

The first stirring member 4 and the second stirring member 5 are roller-like members, and supported by the developing tank 2 in such a manner that they are rotatable by driving means (not shown) around their axes. In the present embodiment, the first stirring member 4 rotates counterclockwise in FIG. 2, and the second stirring member 5 rotates clockwise in FIG. 2.

The first stirring member 4 is provided in such a manner as to face the photosensitive drum 20 with the developing roller 3 between the first stirring member 4 and the photosensitive drum 20 and to be positioned lower than the developing roller 3. In the developing device 10, the developing roller 3 and the first stirring member 4 are positioned in such a manner that a line connecting the axis of the developing roller 3 and the axis of the first stirring member 4 is inclined by 54 degrees with respect to a horizontal plane.

The second stirring member 5 is provided in such a manner as to face the developing roller 3 with the first stirring member 4 between the second stirring member 5 and the developing roller 3 and to be positioned lower than the developing roller 3. The first stirring member 4 and the second stirring member 5 stir developer stored in the developing tank 2 so as to apply even electric charges on the developer (triboelectric charging), and scoop and supply the charged developer to the surrounding of the developing roller 3.

The transferring member 6 is a roller-like member that is supported by the developing tank 2 to be rotatable by driving means (not shown). The transferring member 6 is provided in such a manner as to face the first stirring member 4 with the second stirring member 5 between the transferring member 6 and the first stirring member 4 and to be positioned lower than the toner supply opening 2*b* (in plumb-bob direction of the toner supply opening 2*b*). The transferring member 6 transfers, to the surrounding of the second stirring member 5, a toner supplied from the toner supply opening 2*b* into the developing tank 2.

The regulating member 7 is a rectangular blade. The regulating member 7 is supported by the developing tank 2 and the regulating member supporter 8 in such a manner that the regulating member 7 is positioned above the developing roller 3, an axis direction of the developing roller 3 is parallel to a long side direction of the regulating member 7, and the regulating member 7 faces the surface of the developing roller 3 with a gap therebetween.

The regulating member 7 is a thin plate made of stainless steel. However, the material of the regulating member 7 is not limited to stainless steel and may be a non-magnetic metal such as aluminum or a synthetic resin having elasticity.

The regulating member 7 removes superfluous developer from the developer layer on the surface of the developing roller 3 and regulates the thickness of the developer layer at a certain thickness, thereby adjusting the amount of developer transferred by the developing roller 3. Further, the regulating member 7 also makes friction with the developer layer to generate electric charges on the developer layer, thereby supplying electric charges to the developer that has been insufficiently charged.

The regulating member supporter 8 supports the regulating member 7 in combination with the developing tank 2. Specifically, the regulating member supporter 8 and the developing tank 2 support the regulating member 7 in such a manner that the regulating member 7 is sandwiched by the regulating member supporter 8 and the developing tank 2. The regulating member supporter 8 is made of synthetic resin, but may be made of metal.

With the developing device 10, the developer stored in the developing tank 2 is transferred above the first stirring member 4 (transferred to the side opposite to the side of the plumb-bob direction) by rotations of the first stirring member 4 and the second stirring member 5, and is drawn to the surface of the developing roller 3 by a magnetic force derived from a magnetic member inside the developing roller 3. The developing roller 3 rotates with the developer layer on its surface. The regulating member 7 regulates the thickness of the developer layer at a certain thickness and charges the developer, and then a toner is supplied at the developing nip section to an electrostatic latent image on the photosensitive drum 20. Thus, a development is performed.

After the development, the developing roller 3 further rotates and is supplied with the developer again. On the other hand, the developer removed from the surface of the developing roller 3 by the regulating member 7 passes on the upper surface of the flowing plate 9 in a direction away from the developing roller 3, returns to a space between the second stirring member 5 and the transferring member 6, is remixed with other developer there, and is transferred to the developing roller 3. That is, developer circulates in the developing tank 2. Further, the transferring member 6 transfers, to the surrounding of the second stirring member 5, a toner supplied into the developing tank 2 in accordance with the result of detection by the toner concentration detecting sensor 12.

[Exposing Device]

The exposing device 22 in FIG. 1 is a laser scanning unit including a semiconductor laser as a light source. The laser scanning unit is an optical unit that is made by combining a polygon mirror, a fθ lens, a reflection mirror etc. in addition to the laser light source. The exposing device 22 is not limited to the laser scanning unit, and may be an exposing head using an LED (light emitting diode) array or an EL (electroluminescence) element as a light source.

When the exposing device 22 receives image information of a document read by the scanning section 29 or image information transmitted from an external device, the exposing device 22 emits light according to the image information to the surface of the charged photosensitive drum 20. Consequently, an electrostatic latent image according to the image information is formed on the surface of the photosensitive drum 20.

[Transferring Device]

The transferring device 23 is a roller-like member that is supported by a supporter (not shown) in such a manner as to be rotatable by driving means (not shown) and to be pressed to the photosensitive drum 20.

The transferring device 23 is a roller-like member including a metal core of 8-10 mm in diameter and a conductive elastic layer formed on the surface of the metal core. Examples of the material of the metal core include stainless steel and aluminum. The conductive elastic layer is made by blending a conductive material such as carbon black into a rubber material. Examples of the rubber material include ethylene-propylene rubber (EPDM), expanded EPDM, and urethane foam.

A recording medium (sheet) is supplied one by one by a pick up roller and a resist roller to a pressing section (transfer nip section) between the photosensitive drum 20 and the transferring device 23 in synchronization with transferring of a toner image by rotation of the photosensitive drum 20.

When the recording medium passes through the transfer nip section, the toner image on the surface of the photosensitive drum 20 is transferred onto the recording medium. The transferring device 23 is connected with a power source (not shown) and when the toner image is transferred to the recording medium, a voltage whose polarity is opposite to a charge polarity of a toner constituting the toner image is applied on the transfer device 23. Consequently, the toner image is smoothly transferred onto the recording medium.

[Cleaning Device]

The cleaning device 24 in FIG. 1 includes a cleaning blade (not shown) and a toner storage tank (not shown). The cleaning blade has a rectangular plate shape that is provided in such a manner that a long side of the cleaning blade is parallel to the axis of the photosensitive drum 20 and touches the surface of the photosensitive drum 20.

The cleaning blade removes, from the surface of the photosensitive drum 20, a toner, paper powder etc. remaining on the surface of the photosensitive drum 20 after the toner image has been transferred. The toner storage tank is a container-like member having a space therein, and temporarily stores a toner removed by the cleaning blade. The cleaning device 24 having the above structure cleans the surface of the photosensitive drum 20 after the toner image has been transferred.

[Fixing Device]

The fixing device 25 in FIG. 1 includes a fixing roller 26 and a pressure roller 27. The fixing roller 26 is supported by a supporter (not shown) in such a manner as to be rotatable by driving means (not shown) around the axis of the fixing roller 26.

The fixing roller 26 includes therein a heating member (not shown) and heats and fuses an unfixed toner image on the recording medium transferred from the transfer nip section, thereby fixing the unfixed toner image on the recording medium. The fixing roller 26 is a roller-like member including a core and an elastic layer. The core is made of a metal such as iron, stainless, and aluminum. The elastic layer is made of an elastic material such as silicone rubber and fluorine rubber. The heating member generates heat by receiving a voltage from a power source (not shown). The heating member is a halogen lamp or an infrared lamp.

The pressure roller 27 is a roller-like member that is supported to be rotatable and that is pressed to the fixing roller 26 by a pressing mechanism (not shown). The pressure roller 27 is driven by the rotation of the fixing roller 26. The pressure roller 27 may have the same structure as that of the fixing roller 26. Further, the pressure roller 27 may include therein a heating member or may not. The heating member may be the same as that included in the fixing roller 26.

A section at which the fixing roller 26 and the pressure roller 27 are pressed to each other is referred to as a fixing nip section. When the fixing roller 26 heats a toner image on a recording medium, the pressure roller 27 presses the fused toner to the recording medium, thereby accelerating fixation of the toner image on the recording medium.

When the recording medium on which the toner image has been transferred passes through the fixing nip section, the fixing device 25 fixes the toner image on the recording medium by fusing a toner that constitutes the toner image and pressing the toner on the recording medium. Thus, an image is printed on the recording medium. The recording medium on which the image is printed is output by transferring means (not shown) to the paper output tray 30 provided at the side of the image forming apparatus 1 and is loaded there.

[Paper Feeding Tray]

The paper feeding trays 28 contain recording media such as normal papers, coated papers, color copy sheets, and OHP films. The paper feeding trays 28 contain recording media with different sizes, respectively. Examples of the size of the recording medium include A3, A4, B5, and B4. Further, the paper feeding trays 28 may contain recording media with the same size.

The recording medium in the paper feeding tray 28 is transferred one by one by a pick-up roller, a transferring roller, and a resist roller to the transfer nip section, in synchronization with timing at which the toner image on the surface of the photosensitive drum 20 reaches the transfer nip section.

[Scanner Section]

The scanner section 29 in FIG. 1 includes a document set tray (not shown), a reversing automatic document feeder (not shown) etc. and a document reading device (not shown).

The reversing automatic document feeder transfers a document set on the document set tray to a document reading position of a document platen. The document reading device includes the document platen and a document scanner, and reads an image of a document on the document platen with respect to a plurality of lines (e.g. with respect to every 10 lines).

The document platen is a glass plate member on which a document to be read is set. The document scanner is a carriage containing therein a light source, a first mirror, a second mirror, a third mirror, an image focusing lens, and a CCD line sensor (Charge Coupled Device, photoelectric conversion element) (each not shown). The document scanner shuttles at a predetermined velocity V at a position lower than the document platen and in parallel to the document platen.

The light source is a lamp for emitting light to a document set on the document platen. The first mirror reflects a light image reflected from the document to the second mirror. The second mirror and the third mirror transmits the light image reflected from the first mirror to the image focusing lens while shuttling at a velocity V/2 in accordance with the shuttling of the document scanner. The image focusing lens (optical lens) focuses the light image from the second and third mirrors on the CCD line sensor.

The CCD line sensor is a device for photoelectrically converting the reflected light image focused by the image focusing lens into an electric signal, and outputs the electric signal that is image information to an image processing section in control means. The image processing section processes the image information input from the document reading device or from an external device such as a personal computer, and outputs the processed information to the exposing device 22.

[Corona Charger]

The corona charger 21 in FIG. 1 causes the surface of the photosensitive drum 20 to be charged with a predetermined polarity and a predetermined potential with use of corona discharge. The corona charger 21 in the present embodiment is a charger including a discharging electrode of a sawtooth type. The corona charger 21 is not limited to the sawtooth type and may be a scorotron charger having a tungsten wire as a discharging electrode. However, the corona charger of the sawtooth type generates less amount of ozone than the charger having a tungsten wire as a discharging electrode.

Figure 3:
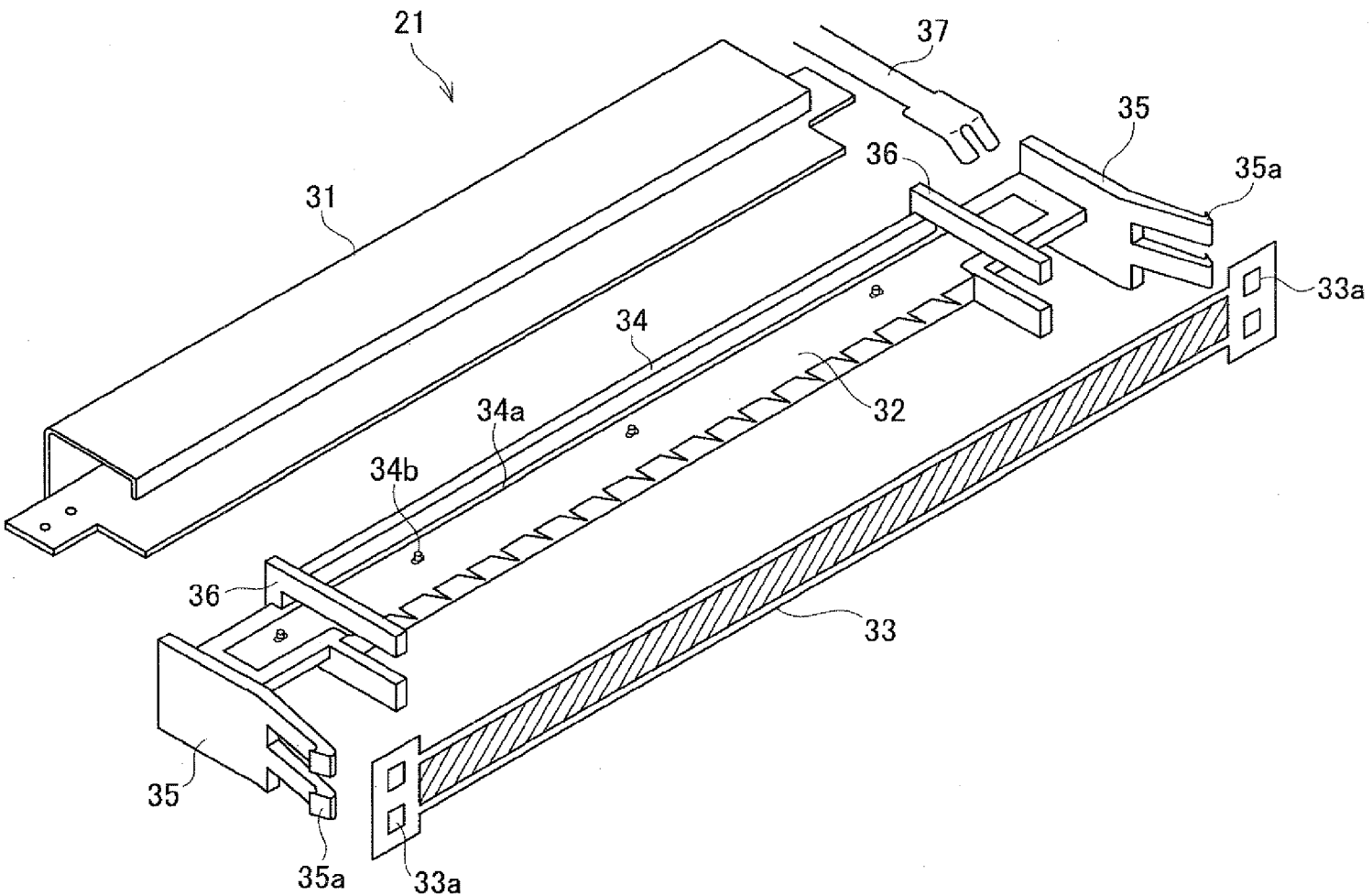
FIG. 3 is an exploded drawing illustrating a corona charger included in the image forming apparatus illustrated in FIG. 1.

FIG. 3 is an exploded perspective drawing illustrating a structure of the corona charger 21. The corona charger 21 includes a conductive shield case 31, a sawtooth electrode 32, a grid electrode 33, and an insulating electrode supporter 34 for supporting each electrode.

The shield case 31 is a conductive shield plate whose length is substantially the same as the length of the axis of the photosensitive drum 20. The shield case 31 has an opening at a side that faces the surface of the photosensitive drum 20.

The sawtooth electrode 32 is an electrode provided with acuminate protrusions for discharging, and is made of a lath-shaped thin plate made of stainless (alloy of iron, chrome, and nickel. An example is JIS standard SUS304 etc.). A distance between acuminate protrusions is set to be substantially a certain value (e.g. 2 mm). The sawtooth electrode 32 is formed through etching processing.

The sawtooth electrode 32 has a plurality of openings for fixing the sawtooth electrode 32. These openings are caused to fit with protrusions 34T on a plane section 34*a* of the insulating electrode supporter 34. Thus, the sawtooth electrode 32 and the shield case 31 are positioned and supported (fixed) by the plane section 34*a* of the electrode supporter 34 in such a manner that the sawtooth electrode 32 and the shield case 31 are electrically insulated from each other.

Further, the electrode supporter 34 is provided with a grid electrode supporter 35 for supporting the grid electrode 33 while electrically insulating the grid electrode 33 from the shield case 31 and the sawtooth electrode 32.

The grid electrode supporter 35 has latching sections 35*a* with hooks for latching which correspond to opening sections 33*a*, respectively, formed at both sides of the grid electrode 33. The grid electrode supporter 35 is subjected to elastic deformation and then the retaining sections 35*a* are inserted into the opening sections 33*a*, and then the grid electrode supporter 35 is restituted. Thus, the grid electrode 33 is supported while a tensile force is added to the grid electrode 33.

As with the sawtooth electrode 32, the grid electrode 33 is obtained by etching a stainless lath-shaped thin plate and evenly forming mesh openings. The retaining sections 35*a* of the grid electrode supporter 35 integrally molded with the electrode supporter 34 are subjected to elastic deformation, and then the retaining sections 35*a* are caused to fit and engage with the opening sections 33*a* formed in the grid electrode 33, and the grid electrode 33 is stretched by the retaining sections 35*a*.

Positioning members 36 are provided at both ends of the shield case 31, and are integrally molded with the electrode supporter 34 in order to determine the position of the electrode supporter 34 in the shield case 31. A spring terminal 37 is a spring terminal that electrically makes elastic touch with the sawtooth electrode 32 in order to supply a power to the sawtooth electrode 32.

The following explains how to combine the corona charger 21 based on members illustrated in FIG. 3. First, the protrusions 34*b* of the plane section 34*a* of the electrode supporter 34 are caused to fit into the openings formed in the sawtooth electrode 32. Thus, the electrode supporter 34 supports the sawtooth electrode 32.

Then, the positioning members 36 of the electrode supporter 34 are caused to fit into ends of the shield case 31, so that the electrode supporter 34 is contained in the shield case 31. Further, the openings 33*a* of the grid electrode 33 are caused to fit with the retaining sections 35*a* of the grid electrode supporter 35, so that the grid electrode 33 is stretched by the grid electrode supporter 35.

Figure 4:
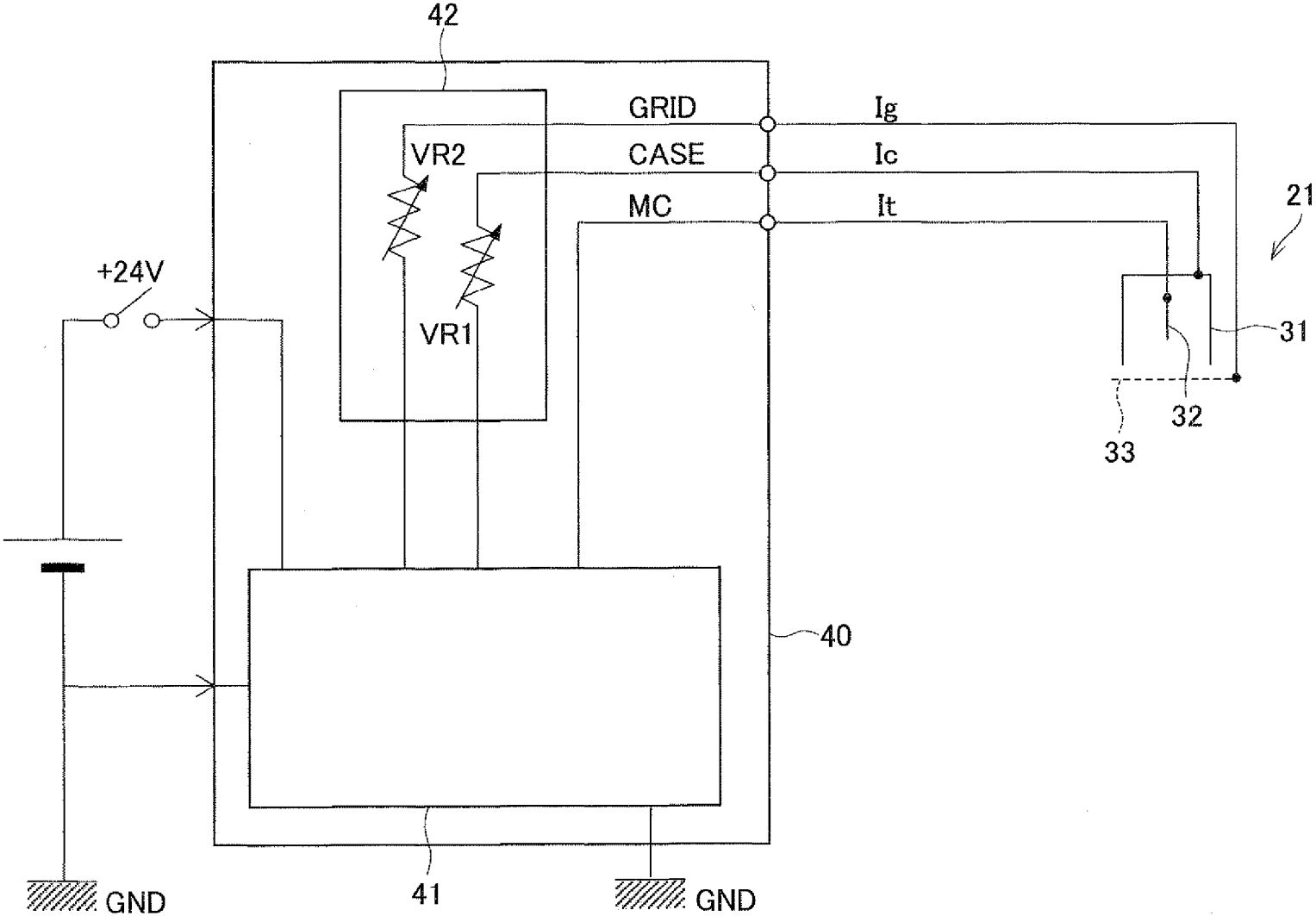
FIG. 4 is a drawing illustrating a power supply circuit for applying a voltage to the corona charger illustrated in FIG. 3.

Then, the following explains a power supply circuit 40 for supplying a voltage to the corona charger 21 with reference to FIG. 4. As illustrated in FIG. 4, predetermined voltages are supplied from the power supply circuit 40 to the sawtooth electrode 32 and the shield case 31, respectively, of the corona charger 21.

In FIG. 4, the power supply circuit 40 includes a voltage conversion circuit 41, and a first voltage of +24V is supplied from a power source to the power conversion circuit 41. The power conversion circuit 41 converts the applied first voltage into a second voltage and outputs the second voltage. The second voltage is a high-level voltage (high voltage).

A voltage output from the voltage conversion circuit 41 is applied to each of an output terminal CASE connected with the shield case 31, an output terminal MC connected with the sawtooth electrode 32, and an output terminal GRID connected with the grid electrode 33. That is, a voltage output from the voltage conversion circuit 41 and from the output terminal CASE is applied to the shield case 31, a voltage output from the voltage conversion circuit 41 and from the output terminal MC is applied to the sawtooth electrode 32, and a voltage output from the voltage conversion circuit 41 and from the output terminal GRID is applied to the grid electrode 33.

Further, the power supply circuit 40 includes a voltage adjusting circuit 42. Out of voltages output from the voltage conversion circuit 41, the voltages applied to the output terminal CASE and the output terminal GRID can be adjusted by the voltage adjusting circuit 42. The voltage adjusting circuit 42 includes a variable resistor VR1 connected with the voltage conversion circuit 41 and the output terminal CASE, and a variable resistor VR2 connected with the voltage conversion circuit 41 and the output terminal GRID. Consequently, by adjusting resistance of the variable resistor VR1, the voltage output from the output terminal CASE can be adjusted, and by adjusting resistance of the variable resistor VR2, the voltage output from the output terminal GRID can be adjusted.

With the above structure, a high voltage V is supplied from the output terminal MC to the sawtooth electrode 32, a high voltage Vc is supplied from the output terminal CASE to the shield case 31, and a high voltage Vg is supplied from the output terminal GRID to the grid electrode 33.

The power supply circuit 40 supplies the voltages to the corona charger 21, and consequently corona discharge occurs at acuminate protrusions of the sawtooth electrode 32. The corona discharge allows a total current It to flow into the sawtooth electrode 32. Here, a grid current Ig flowing in the grid electrode 33 can be adjusted suitably by changing resistance of the variable resistor VR2 of the voltage adjusting circuit 42. Similarly, a case current Ie flows in the shield case 31 due to the coronal discharge, and the case current Ic can be adjusted by changing resistance of the variable resistor VR1 of the voltage adjusting circuit 42.

The current It flowing in the sawtooth electrode 32 is equal to a sum of the case current Ic and the grid current Ig. That is, the current (total current) It flows dividedly into the shield case 31 and the grid electrode 33. Therefore, the total current It is represented by Equation (1) below.

$$It = Ic + Ig \qquad \text{Equation (1)}$$

Further, keeping the total current It constant allows controlling a current flowing in the sawtooth electrode 32 to be constant. Therefore, the voltage conversion circuit 41 of the power supply circuit 40 performs a constant current control.

In the corona charger 21 as explained above, when foreign matters attach to the sawtooth electrode 32, a portion to which the foreign matters attach drops its discharging function, making it impossible to evenly charge the photosensitive drum 20, resulting in charge unevenness. When charge unevenness occurs, image defects such as a black streak on an obtained image appears. Therefore, in order to prevent the image defects, it is necessary to examine carefully the cause of foreign matters attaching to the sawtooth electrode 32, and to remove the cause so as to prevent the foreign matters from attaching to the sawtooth electrode 32 (i.e. it is necessary to drop the amount of foreign matters produced at the sawtooth electrode 32). Accordingly, the inventors of the present invention diligently studied the cause of the foreign matters attaching to the sawtooth electrode 32.

The cause of the foreign matters attaching to the sawtooth electrode 32 is considered as follows. In an external additive (external additive whose main components are fine particles of oxides such as silica, aluminum oxide, and titanium oxide) added to a toner used in an image forming process, much amount of hydroxyl groups exist on the surface of the external additive, and consequently the external additive absorbs much amount of water under a high moisture condition. When the external additive containing much amount of absorbed water is added to a toner, a charge amount of the toner drops, which causes inconvenience such as photographic fog. In order to prevent the inconvenience, in general, a hydrophilic hydroxyl group existing on the surface of the external additive (surfaces of oxide fine particles) is converted into a hydrophobic functional group with use of a silane coupling agent (hydrophobizing process). In most cases, dimethyldichlorosilane is used as the silane coupling agent. In a case of the hydrophobizing process with use of dimethyldichlorosilane, a hydroxyl group on the surface of the external additive is converted into a dimethylsilyl group. In this reactive process, octamethylcyclotetrasiloxane represented by [Chemical Formula 1] is produced as a byproduct (in some cases, the silane coupling agent contains octamethylcyclotetrasiloxane as its material).

[Chemical Formula 1]

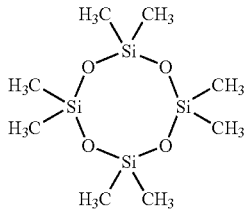

It is supposed that octamethylcyclotetrasiloxane remains in the external additive in such a manner as to attach to the surface of the external additive. Although octamethylcyclotetrasiloxane has its boiling point at 175° C., octamethylcyclotetrasiloxane is also likely to volatilize at a room temperature.

It is supposed that when a toner containing the external additive to which octamethylcyclotetrasiloxane attaches is used in the image forming apparatus 1, octamethycyclotetrasiloxane volatilizes gradually from the toner, and attaches to the sawtooth electrode 32 of the corona charger 21.

It is supposed that in the corona charger 21, when the image forming process is performed, a high voltage is applied and corona discharge occurs, oxidation-reduction occurs due to the discharge voltage, octamethylcyclotetrasiloxane chemically changes into a non-volatile silicon compound, which attaches to the sawtooth electrode 32 as foreign matters and is accumulated gradually.

The inventors of the present invention considered as follows. Even in a case of using an external additive whose main components are oxide fine particles in which dimethylsilyl groups are introduced to surfaces thereof, when the amount of octamethylcyclotetrasiloxane volatilizing in a later-mentioned first volatilizing test is not more than a predetermined amount with respect to the external additive, it is possible to prevent foreign matters (impurities) from attaching to the discharging electrode when performing an image forming process with use of a toner containing the external additive.

The following explains the external additive of the present embodiment for toner use in more detail. The external additive of the present embodiment for toner use is characterized in that the external additive contains oxide fine particles as main components, dimethylsilyl groups are introduced to the surfaces of the oxide fine particles, and the amount of volatilizing octamethylcyclotetrasiloxane measured in the first volatilizing test with respect to the external additive is 0.2 μg or less.

Here, the following explains procedures of the first volatilizing test in detail. First, a sealed container of 50 litters in volume was provided, and the inside of the container was heated up to 120° C. and maintained at the temperature. 2.0 g of the external additive that was a test subject was put in the container, and 10 minutes later gas (air) inside the container was began to be sampled by a sampling pump SP204-50 (manufactured by GL Sciences Inc.). The sampling was performed in such a manner that while keeping the temperature inside the container at 120° C., gas was continued to be sampled at a rate of 0.2 litter per 1 minute for 30 minutes and was sent to a Tenax collecting tube so that gas of 6 litters in total amount was collected in the Tenax collecting tube.

Next, using a gas chromatography analyzer (manufactured by Agilent, 6890/5973 inert MSD) and a thermal desorption device (manufactured by GERSTEL K.K., TDS/C1S4 SYSTEM), the amount of octamethylcyclotetrasiloxane contained in the gas collected in the Tenax collecting tube was measured. The measured amount was considered as the volatilizing amount.

That is, the first volatilizing test was a test in which 2.0 g of the external additive was put as a sample in the container and the inside of the container was kept at 120° C. for 10 minutes so that octamethylcyclotetrasiloxane volatilized from the external additive. The volatilizing amount is the amount of octamethylcyclotetrasiloxane that volatilized from the external additive inside the container in the test.

In the analysis using the thermal desorption device, an injection temperature was 280° C. and a separation column of 60 m in length in which a carrier coated with dimethylpolysiloxane was filled was used.

Later-mentioned test examples revealed that when the image forming apparatus 1 used a toner including the external additive whose volatilizing amount of octamethylcyclotetrasiloxane in the first volatilizing test was 0.2 μg or more, inconvenience such as black streaks on an obtained image was generated. The reason for the generation of the inconvenience is that when the image forming apparatus 1 uses a toner containing the external additive containing much amount of octamethylcyclotetrasiloxane, foreign matters made of a silicon compound attach gradually to the sawtooth electrode 32 of the corona charger 21, and as a result corona discharge gets unstable, the photosensitive drum cannot be evenly charged, and charge unevenness occurs, which generates black streaks on the obtained image.

Later-mentioned test examples revealed that when image formation was performed with use of a toner containing the external additive in which dimethylsilyl groups were introduced to the surfaces of the oxide fine particles that were main components and the volatilizing amount of octamethylcyclotetrasiloxane measured in the first volatilizing test was 0.2 μg or less, it was possible to prevent foreign matters from attaching to the sawtooth electrode 32 of the corona charger 21, thereby preventing deterioration in image due to the foreign matters.

Next, the following explains how to produce the external additive in which dimethylsilyl groups are introduced to the surfaces of the oxide fine particles that are main components and the volatilizing amount of octamethylcyclotetrasiloxane measured in the first volatilizing test is 0.2 μg or less.

First, oxide fine particles (such as alumina, silica, and titania) in which dimethylsilyl groups are introduced to surfaces thereof are produced through a publicly known method. The oxide fine particles are caused to flow in a stirring tank of a stirring device such as a mixer including a heating mechanism, and air at 100-200° C. is sent to the stirring tank for 30-60 minutes, so that octamethylcyclotetrasiloxane volatilizes from the oxide fine particles. Consequently, the external additive in which dimethylsilyl groups are introduced to the surfaces of the oxide fine particles that are main components and the volatilizing amount of octamethylcyclotetrasiloxane measured in the first volatilizing test is 0.2 μg or less is obtained.

Too little amount of air sent to the stirring tank does not allow octamethylcyclotetrasiloxane to be sufficiently removed, although depending on the amount of oxide fine particles stirred in the stirring tank. Therefore, it is necessary to send sufficient amount of air. The amount of air to be sent may be determined suitably so that the volatilizing amount of octamethylcyclotetrasiloxane is 0.2 μg or less. Further, when a duct (exhausting path) through which air exhausted from the stirring tank passes is provided with a condenser to recover octamethylcyclotetrasiloxane, it is possible to circulate heated air.

Further, main components of the external additive may be oxide fine particles of 5-50 nm in a number average particle size, having hydroxyl groups on surfaces thereof. Examples of the oxide fine particles include: fumed silica (silicon dioxide, $SiO_2$) that is obtained through a gas-phase thermal hydrolysis method, alumina (aluminum oxide, $Al_2O_3$), and titania (titan oxide, $TiO_2$); and co-oxide of silicon and aluminum. Specific examples of the oxide fine particles include: AEROSIL 50 (average particle size: approximately 30 nm), AEROSIL 90 (average particle size: approximately 30 nm), AEROSIL 130 (average particle size: approximately 16 nm), AEROSIL 200 (average particle size: approximately 12 nm), AEROSIL 300 (average particle size: approximately 7 nm), and AEROSIL 380 (average particle size: approximately 7 nm) that are manufactured by Japan AEROSIL Co.; and aluminum oxide C (average particle size: approximately 13 nm), titanium oxide P-25 (average particle size: approximately 21 nm), and MOX170 (average particle size: approximately 15 nm) that are manufactured by Degussa.

Among the above oxide fine particles, silica fine particles to which dimethylsilyl groups are introduced through a silane coupling treatment have an excellent insulating property. The reason is supposed to be that the silica fine particles have much amount of active hydroxyl groups on surfaces thereof are likely to react with a silane coupling agent, and it is easy to introduce dimethylsilyl groups.

A toner containing silica fine particles as an external additive is less likely to drop its charging amount due to the high insulating property of the silica fine particles, and therefore less likely to generate photographic fog. Therefore, the silica fine particles to which dimethylsilyl groups are introduced through the silane coupling treatment are preferable as the external additive for toner use.

Examples of the silane coupling agent used for introducing dimethylsilyl groups to the oxide fine particles include dimethyldichlorosilane and octamethylcyclotetrasiloxane.

In particular, the silica fine particles in which dimethylsilyl groups are introduced to surfaces thereof with use of dimethyldichlorosilane as a silane coupling agent are excellent in their hydrophobic property and insulating property. Therefore, a toner containing the silica fine particles as an external additive has stable charging amount under a high moisture environment and are less likely to cause inconvenience such as photographic fog. Consequently, the silica fine particles in which dimethylsilyl groups are introduced to surfaces thereof with use of dimethyldichlorosilane as a silane coupling agent are preferable as the external additive for toner use.

Further, preferable as the external additive are silica fine particles that are obtained by stirring, in a stirring tank of a stirring device, silica fine particles in which dimethylsilyl groups are introduced by dimethyldichlorosilane to surfaces thereof while sending dry wind at 150° C. to the stirring tank for 30 minutes so as to volatilize octamethylcyclotetrasiloxane (the condition for sending the wind is such that the amount of sent air with respect to 100 g of the silica fine particles is 0.1 $m^3$/min.). With use of the silica fine particles, it is possible to highly effectively prevent foreign matters from attaching to the discharge electrode of the corona charger.

The reason is supposed to be as follows. To the silica fine particles in which dimethylsilyl groups are introduced to surfaces thereof with use of dimethyldichlorosilane, many kinds of volatile organic silicon compounds (whose boiling points are 99° C. or more) as well as octamethylcyclotetrasiloxane are attached. In the image forming apparatus 1, a toner is fixed by a fixing device to a recording medium such as a paper. At that time, a toner is heated up to a temperature where the toner melts (110° C.-150° C.) and consequently the volatile organic silicon compounds with high boiling points that attach to the surfaces of the silica fine particles volatilize due to the heating by the fixing device and attach to the sawtooth electrode 32 of the corona charger 21. In contrast thereto, when the silica fine particles having been dried by dry air at 150° C. are used as an external additive for toner use, not only octamethylcyclotetrasiloxane but also organic silicon compounds other than octamethylcyclotetrasiloxane have already volatilized sufficiently, thereby reducing the amount of foreign matters attaching to the discharge electrode of the corona charger.

Further, a treatment for converting hydrophilic hydroxyl groups on L the surfaces of the oxide fine particles into hydrophobic functional groups with use of a silane coupling agent may be performed through a publicly known method. An example is a method for spraying a silane coupling agent to the oxide fine particles having hydroxyl groups on surfaces thereof while stirring the oxide fine particles, and thereafter heating the oxide fine particles.

Further, it is preferable that the aforementioned external additive of the present embodiment for toner use is added to a toner in such a manner that a weight percentage concentration of the external additive ranges from 0.5 wt % to 3 wt %.

When the weight percentage concentration is less than 0.5 wt %, fluidity of a toner cannot be increased. When the weight percentage concentration is more than 3 wt %, a fixing property is likely to drop in a fixing process. The weight percentage concentration is obtained by Equation (2) below.

$$\text{Weight percentage concentration (wt \%)} = \text{weight of added external additive/total weight of a toner including external additive} \times 100 \quad \text{Equation (2)}$$

Further, it is preferable that a number average particle size of the aforementioned external additive of the present embodiment for toner use ranges from 7 nm to 30 nm. When the external additive whose number average particle size ranges from 7 nm to 30 nm is added to a toner, it is possible to assure good fixing property of the toner, good charging property of the toner, and good fluidity of the toner, resulting in a high-quality image.

When the external additive is added to the toner, a part of the external additive is embedded in color resin particles included in the toner. Octamethylcyclotetrasiloxane attaching to the surface of the external additive which is embedded in the color resin particles is little likely to volatilize, whereas octamethylcyclotetrasiloxane attaching to the surface of the external additive which is in contact with outer air is likely to volatilize, and attaches to the sawtooth electrode 32 of the corona charger 21.

To be more specific, it was found that when an image is formed using a toner which contains the external additive of the present embodiment (external additive whose main components are oxide fine particles in which dimethylsilyl groups are introduced to surfaces thereof through the hydrophobic treatment) and from which 0.02 μg or more of octamethylcyclotetrasiloxane volatilizes in a later-mentioned second volatilizing test, black streaks appear on a formed image and deterioration in image occurs (see later-mentioned test examples).

The reason is as follows. When an image is formed using a toner from which 0.02 μg or more of octamethylcyclotetrasiloxane volatilizes in the second volatilizing test, octamethylcyclotetrasiloxane volatilizes particularly in the fixing process, foreign matters attach to the sawtooth electrode 32 of the corona charger 21 because of the volatilization, charge unevenness occurs, and black streaks are more likely to appear on a formed image.

Therefore, it is preferable to use a toner which contains the external additive whose main components are oxide fine particles in which dimethylsilyl groups are introduced to surfaces thereof through the hydrophobic treatment and from which not more than 0.02 μg of octamethylcyclotetrasiloxane volatilizes in the second volatilizing test.

Here, a procedure of the second volatilizing test is explained in detail. First, a sealed container of 50 litters in capacity was provided and the inside of the sealed container was heated up to 100° C. and kept at the temperature. Then, an aluminum dish (20 cm×20 cm) in which 10 g of a toner to be tested was evenly spread was put in the sealed container and 30 minutes later gas (air) in the sealed container was begun to be sampled by a sampling pump SP204-50 (manufactured by GL Sciences. Inc.). The sampling was performed in such a manner that the inside of the sealed container was kept at 10° C. and gas was continued to be sampled at a ratio of 0.2 litter/1 min for 30 minutes and sent to a Tenax collecting tube so that 6 litters of gas in total was collected in the Tenax collecting tube.

The amount of octamethylcyclotetrasiloxane contained in the gas collected in the Tenax collecting tube was measured and the measured amount was regarded as the volatilizing amount. The method for measuring the amount of contained octamethylcyclotetrasiloxane in the second volatilizing test was the same as that in the first volatilizing test and therefore explanation thereof is omitted here.

That is, the second volatilizing test is a test in which 10 g of a toner containing the external additive whose main components were oxide fine particles to which dimethylsilyl groups were introduced was put in the sealed container and the inside of the sealed container was kept at 100° C. for 30 minutes so that octamethylcyclotetrasiloxane volatilized from the toner. The volatilizing amount means the amount of octamethylcyclotetrasiloxane having volatilized from the toner in the sealed container in the second volatilizing test.

TEST EXAMPLES

The inventors of the present invention performed a test in which external additives G1-G5 shown in [Table 1] below was produced and relations between conditions under which G1-G5 were produced and qualities of G1-G5, respectively, were analyzed. Here, the qualities of G1-G5 mean the amounts of octamethylcyclotetrasiloxane volatilizing from G1-G5 in the first volatilizing test.

TABLE 1

| External additive (Oxide fine particles) | Wind-sending and heating condition | Volatilizing amount of octamethylcyclotetrasiloxane (μg) |
|---|---|---|
| G1 | 150° C., 60 min | 0.05 |
| G2 | 120° C., 60 min | 0.10 |
| G3 | 120° C., 30 min | 0.20 |
| G4 | 60° C., 30 min | 0.40 |
| G5 | none | 0.80 |

First, how to produce the external additives G1-G5 is explained. 100 g of hydrophobic silica fine particles manufactured by AEROSIL (product name: R8200, number average particle size was 12 nm) were prepared as oxide fine particles in which dimethylsilyl groups were introduced to surfaces thereof through a surface treatment by dimethyldichlorosilane. 100 g of the hydrophobic silica fine particles were put in a gas flow mixer (manufactured by MITSUI MINING CO., LTD.: Henschel mixer) provided with an air supply opening and an air exhaust opening. In the gas flow mixer, while stirring the hydrophobic fine particles with peripheral velocity of a stirring wing being 5 m/sec., air at 150° C. was sent from the air supply opening. The air was sent at a ratio of 0.1 $m^3$/min for 30 minutes, so that octamethylcyclotetrasiloxane on the surface of the hydrophobic silica fine particles was volatilized and removed. The hydrophobic silica fine particles from which octamethylcyclotetrasiloxane was removed were regarded as an external additive G1.

Further, an external additive G2 was produced in the same manner as the external additive G1 except that the temperature of air sent in the gas flow mixer was 120° C. Further, an external additive G3 was produced in the same manner as the external additive G2 except that air was sent in the gas flow mixer for 30 minutes.

Further, an external additive G4 was produced in the same manner as the external additive G3 except that the temperature of air sent in the gas flow mixer was 60° C. Further, the hydrophobic silica fine particles before being subjected to wind-sending and heating in the gas flow mixer (i.e. before being put in the gas flow mixer) were regarded as an external additive G1.

The first volatilizing test was performed with respect to the external additives G1-G5 produced as described above, and the volatilizing amounts of octamethylcyclotetrasiloxane were measured. Table 1 shows the result of measurement. As shown in Table 1, it was confirmed that the volatilizing amount of octamethylcyclotetrasiloxane in the first volatilizing test drops as the temperature of heated air sent to the external additive in the gas flow mixer when producing the external additive is set to be higher, and the volatilizing amount drops as the time to send the heated air to the external additive in the gas flow mixer when producing the external additive is longer.

Further, the inventors of the present invention produced toners T1-T5 shown in Table 2 below with use of the external additives G1-G5 shown in Table 1, and analyzed the toners T1-T5.

TABLE 2

| Toner | External additive (oxide fine particles) | Amount of Added external additive (wt %) | Volatilizing amount of octamethylcyclotetrasiloxane (μg) | Black streaks on image |
|---|---|---|---|---|
| T1 | G1 | 2 | Less than 0.01 | Not appeared |
| T2 | G2 | 2 | Less than 0.01 | Not appeared |
| T3 | G3 | 2 | 0.02 | Not appeared |
| T4 | G4 | 2 | 0.04 | Appeared a little |
| T5 | G5 | 2 | 0.06 | Appeared |

First, how to produce the toners T1-T5 is explained. The toner T1 was produced by adding the external additive G1 to color resin particles so that a weight percentage concentration represented by Equation (2) became 2 wt %. The addition was performed in such a manner that the color resin particles and the external additive were put in a gas flow mixer (manufactured by MITSUI MINING CO., LTD.: Henschel mixer) and mixed for two minutes with peripheral velocity of a stirring wing being 15 m/sec.

Further, a toner T2 was produced in the same manner as the toner T1 except that the external additive to be added was G2. Further, a toner T3 was produced in the same manner as the toner T1 except that the external additive to be added was G3. Further, a toner T4 was produced in the same manner as the toner T1 except that the external additive to be added was G4. Further, a toner T5 was produced in the same manner as the toner T1 except that the external additive to be added was G5.

The second volatilizing test was performed with respect to the toners T1-T5 thus produced, and the volatilizing amounts of octamethylcyclotetrasiloxane were measured. Table 2 shows the result of the measurement.

Further, images were printed with use of the toners T1-T5, and it was judged whether black streaks appeared or not on the printed images. The judgment was performed as follows. Using a test machine of the image forming apparatus 1 illustrated in FIG. 1, continuous 50 thousand sheet printing tests were performed with respect to the toners T1-T5. The test machine was set in such a manner that peripheral velocity of the photosensitive drum 20 was 400 mm/sec., peripheral velocity of the developing roller 3 was 560 mm/sec., a gap between the photosensitive drum 20 and the developing roller 3 was 0.42 mm, and a gap between the developing roller 3 and the regulating member 7 was 0.5 mm. Further, in the test machine, a surface electric potential and a developing bias of the photosensitive drum 20 were adjusted so that the amount of a toner attaching to a sheet was 0.5 mg/$cm^2$ and the amount of a toner attaching to a non-image section was minimum when printing a solid image (concentration was 100%). Further, in the test machine, using an A4 electrophotographic sheet (multi receiver: manufactured by Sharp Document Systems Corporation), text images were printed so that coverage of an image printed on a sheet was 60%.

Figure 5:
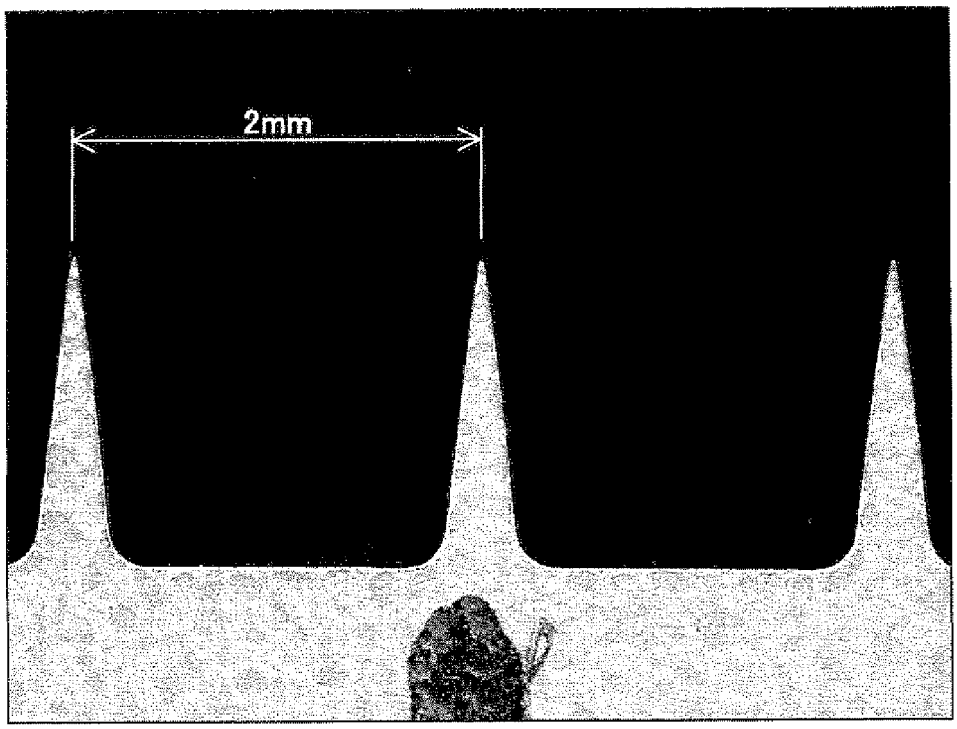
FIG. 5 is a photograph obtained by capturing a sawtooth electrode after continuously printing 50 thousand sheets with use of a toner T1.

As described above, 50 thousand sheets of images were printed with respect to each of the toners T1-T5, and it was judged whether black streaks appeared on the printed images or not. Table 2 shows the result of the judgment. As shown in Table 2, in the cases of the toners T1-T3, after continuously printing 50 thousand sheets, black streaks did not appear at all on each of 50 thousand printed images. FIG. 5 is a photograph of the sawtooth electrode (discharging electrode) 32 of the corona charger 21 after 50 thousand sheets were printed using the toner T1. No attachment was seen at ends of the sawtooth electrode 32. The observation was performed with use of a scanning electron microscope (SEM).

Figure 6:
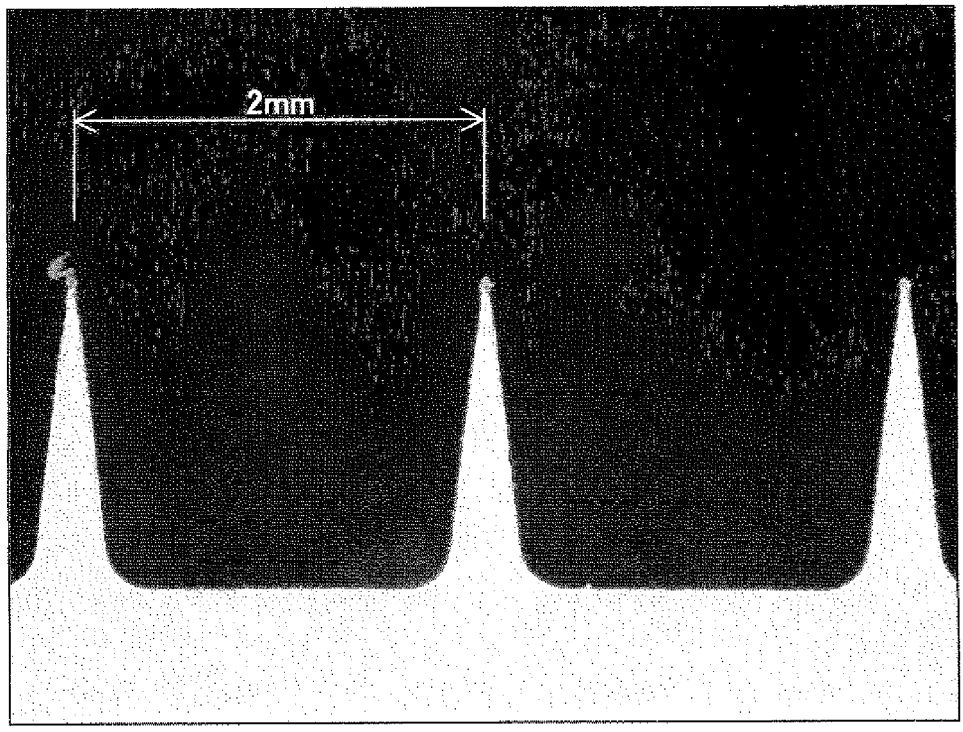
FIG. 6 is a photograph obtained by capturing a sawtooth electrode after continuously printing 50 thousand sheets with use of a toner T5.

Further, as shown in Table 2, in the case of continuously printing 50 thousand sheets using the toner T4, a little amount of black streaks were seen on an image after printing 50 thousand sheets. In the case of continuously printing 50 thousand sheets using the toner T5, black streaks were clearly seen on an image after printing 50 thousand sheets. FIG. 6 is a photograph captured with the scanning electron microscope, showing the sawtooth electrode (discharging electrode) 32 of the corona charger 21 after 50 thousand sheets were printed using the toner T5. Foreign matters were seen attaching to ends of the sawtooth electrode 32.

Foreign matters attaching to ends of the sawtooth electrode (discharging electrode) 32 of the corona charger 12 were analyzed with SEM-EDX and as a result a peak indicative of the existence of silicon elements and a peak indicative of the existence of oxygen elements were detected. This is supposed to indicate that foreign matters attaching to the sawtooth electrode 32 derived from octamethylcyclotetrasiloxane having volatilized from the external additive contained in the toner.

Further, examination of the result shown in Table 2 shows that when an image is printed using a toner whose volatilizing amount of octamethylcyclotetrasiloxane in the second volatilizing test was 0.02 μg or less, a good image is obtained, and when an image is printed using a toner whose volatilizing amount of octamethylcyclotetrasiloxane in the second volatilizing test was more than 0.02 μg, black streaks appear on the image.

Further, examination of the results of Tables 1 and 2 shows that when an image is printed using the toners T1-T3 containing the external additives G1-G3 whose volatilizing amount of octamethylcyclotetrasiloxane in the first volatilizing test was 0.2 μg or less, a good image is obtained, and when an image is printed using the toners T4 and T5 containing the external additives G4 and G5 whose volatilizing amount of octamethylcyclotetrasiloxane in the first volatilizing test was more than 0.2 μg, black streaks appear on the image.

In the test examples, the color resin particles used in the toners T1-T5 were produced through the following steps S1-S5. First, in S1, the following (a)-(d) were mixed with one another for 10 minutes in the gas flow mixer (manufactured by MITSUI MINING CO., LTD.: Henschel mixer).

(a) 100 parts by weight of binder resin (polyester resin obtained by condensation-polymerizing bisphenol A propyleneoxide, terephthalic acid, and trimellitic anhydride as a monomer)

(b) 6 parts by weight of carbon black (manufactured by Mitsubishi Chemical Corporation: MA-100)

(c) 2 parts by weight of charge control agent (manufactured by Japan Carlit Co., Ltd.: LR-147)

(d) 2 parts by weight of polypropylene wax (manufactured by Sanyo Chemical Industries, Ltd.: Viscol 550P)

In S2, the mixture obtained in S1 was melted and kneaded by a kneading and dispersing device (manufactured by MITSUI MINING CO., LTD.: Kneadex MOS140-800). In S3, the resultant in S2 was cooled down and then roughly pulverized by a cutting mill. In S4, the resultant in S3 was finely pulverized by a fine pulverizer (manufactured by MITSUI MINING CO., LTD.: CGS). In S5, the resultant in S4 was classified by a wind power classifying device (manufactured by HOSOKAWA MICRON CORPORATION: TSP separator). Through S1-S5, it is possible to obtain color resin particles of 6.5 μm in a volume average particle size and 1.8 $m^2/g$ in BET specific surface area. The volume average particle size was measured by Coulter Multisizer 2 (manufactured by Beckman Coulter K.K.).

Further, in the test examples, the toners T1-T5 were used in the image forming apparatus 1 in such a manner as to be contained in two-component developer. The two-component developer was prepared by putting 6 parts by weight of a toner and 94 parts by weight of a carrier in a Nauta mixer (product name: VL-0, manufactured by HOSOKAWA MICRON CORPORATION) and stirring and mixing the toner and the carrier for 20 minutes.

The carrier was produced through the following method. First, a ferrite raw material was mixed in a ball mill and then calcinated in a rotary kiln at 900° C. The resulting calcinated powder was finely pulverized by a wet type pulverizer into particles of 2 μm in an average particle size with use of steal balls as pulverizing media. The resulting ferrite fine powder was granulated through a spray dry method and the granular resultant was sintered at 1300° C. After the sintering, the resultant was pulverized by a crusher into core particles made of ferrite components, of approximately 50 μm in a volume average particle size and $1\times10^9$ Ωcm in volume resistivity. Then, silicone resin (product name: TSR115, manufactured by Shin-Etsu Chemical Co., Ltd.) was dissolved and dispersed in toluene in order to prepare a covering solution for covering the core particles. 5 parts by weight of the covering solution (silicone resin conversion) was sprayed by a spray covering device to 100 parts by weight of the core particles so that the core particles were covered. Thereafter, toluene was completely evaporated and removed so as to prepare a carrier of 50 μm in a volume average particle size, 1 μm in thickness of silicone resin, and 65 emu/g in saturation magnetization.

VARIATION EXAMPLE

The following explains variations of color resin particles, binder resin, a coloring agent, a charge control agent, a release agent, and a carrier in this order, that are used in the toner of the present embodiment. The toner of the present embodiment can be prepared, for example, by mixing the oxide fine particles and the color resin particles with use of a gas flow mixer such as a Henschel mixer (i.e. externally adding the oxide fine particles to the color resin particles). A volume average particle size of the color resin particles preferably ranges from 3 to 15 μm. The volume average particle size was measured with a Coulter counter (manufactured by Coulter Corporation) using an aperture of (a) Color Resin Particles Color resin particles can be prepared through a publicly known method such as a kneading and pulverizing method and a polymerization method. For example, in the kneading and pulverizing method, binder resin, a coloring agent, a charge control agent, a release agent, and other additives are mixed by a mixer such as a Henschel mixer, a super mixer, a mechanomill, and a Q-type mixer, and the resulting mixture was melted and kneaded by a kneader such as a biaxial kneader and a uniaxial kneader at approximately 100-180° C. The resultant was cooled down and solidified, and then pulverized by an air-type pulverizer such as a jet mill, and if necessary, subjected to size adjustment such as classification. Thus, the color resin particles can be prepared.

(b) Binder Resin

Examples of binder resin include publicly known styrene/acrylic resin and polyester resin. Among them, linear or non-linear polyester resin is particularly preferable. Polyester resin is excellent since it has all of mechanical strength (less likely to produce fine powder), a fixing property (less likely to detach from a paper after being fixed thereto), and an anti-hot-offset property.

The polyester resin can be obtained by polymerizing bivalent or higher polyvalent alcohol and bivalent or higher polybasic acid. In the polymerization, a monomer composition made of trivalent or higher polyvalent alcohol or trivalent or higher polybasic acid may be added if necessary.

Examples of bivalent alcohol used in polymerizing polyester resin include: glycols such as ethylene glycol, diethylene glycol, triethylene glycol, 1,2-propyleneglycol, 1,3-propyleneglycol, 1,4-butanediol, and neopentylglycol; diols such as 1,4-butenediol, 1,5-pentanediol, 1,6-hexanediol; and bisphenol A, hydrogen-added bisphenol A, and polyoxyethylene bisphenol A. Further, bisphenol A alkylene oxide adduct such as polyoxypropylene bisphenol A and the like may be used.

Examples of trivalent or higher polyvalent alcohol include sorbitol, 1,2,3,6-hexantetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene.

Examples of the bivalent polybasic acid include maleic acid, fumaric acid, citraconic acid, itaconic acid, glutaconic acid, phthalic acid, isophthalic acid, terephthalic acid, cyclohexanedicarbonic acid, succinic acid, adipic acid, sebacic acid, azelaic acid, and malonic acid, and anhydrides thereof, and lower alkylester. Further, alkenyl succinic acids such as n-dodecenylsuccinic acid or alkylsuccinic acids such as n-dodecylsuccinic acid may be used.

Examples of trivalent or higher polybasic acid include 1,2,4-benzenetricarobonic acid, 1,2,5-benzenetricarobnic acid, 1,2,4-cyclohexanetricarbonic acid, 2,5,7-naphtalanetricarbonic acid, 1,2,4-naphtalenetricarbonic acid, 1,2,5-hexanetricarbonic acid, 1,3-dicarboxyl-2-methyl-2-methylenecarboxypropane, tetra(methylenecarboxyl)methane, and 1,2,7,8-octanetetracarbonic acid, and anhydrides thereof.

(c) Coloring Agent

The coloring agent used in the toner of the present embodiment may be a publicly known pigment or colorant. Specific examples of the coloring agent for a black toner include carbon black and magnetite.

Examples of the coloring agent for a yellow toner include: acetoacetic acid arylamide type monoazo yellow pigments such as C. I. pigment yellow 1, the same 3, the same 74, the same 97, and the same 98: acetoacetic acid arylamide type disazo yellow pigments such as C. I. pigment yellow 12, the same 13, the same 14, and the same 17; condensation monoazo yellow pigments such as C. I. pigment yellow 93 and the same 155; yellow pigments such as C. I. pigment yellow 180, the same 150, and the same 185; and yellow colorants such as C. I. solvent yellow 19, the same 77, the same 79, and C. I. disperse yellow 164.

Examples of the coloring agent for a magenta toner include: red or sanguine pigments such as C. I. pigment red 48, the same 49:1, the same 53:1, the same 57, the same 57:1, the same 81, the same 122, the same 5, the same 146, the same 184, the same 238, and C. I. pigment violet 19; and red colorants such as C. I. solvent red 49, the same 52, the same 58, and the same 8.

Examples of the coloring agent for a cyan toner include: blue pigments such as copper phthalocyanine (e.g. C. I. pigment blue 15:3 and the same 15:4) and its derivative; and green pigments such as C. I. pigment green 7, the same 36 (phthalocyanine green).

The amount of the coloring agent to be added ranges preferably from 1 to 15 parts by weight, more preferably from 2 to 10 parts by weight, with respect to 100 parts by weight of the binder resin.

(d) Charge Control Agent

The charge control agent used in the toner of the present embodiment may be a publicly known charge control agent. Specific examples of the charge control agent for giving negative charging property include chromeazo complex colorant, iron azo complex colorant, cobalt azo complex colorant, chrome/zinc/aluminum/boron complex with salicylic acid or its derivative and salt compound of salicylic acid or its derivative, chrome/zinc/aluminum/boron complex with naphthol acid or its derivative and salt compound of naphthol acid or its derivative, chrome/zinc/aluminum/boron complex with benzyl acid or its derivative and salt compound of benzyl acid or its derivative, long-chain alkyl carbonic acid salt, and long-chain alkyl sulfonic acid salt.

Examples of the charge control agent for a positively charged toner include nigrosin colorant and derivative thereof, triphenylmetane derivative, and derivatives of quaternary ammonium salt, quaternary phosphonium salt, quaternary pyridinium salt, guanidine salt and amidin salt.

The amount of the charge control agent to be added ranges preferably from 0.1 to 20 parts by weight, more preferably from 0.5 to 10 parts by weight, with respect to 100 parts by weight of the binder resin.

(e) Release Agent

Examples of the release agent usable in the toner of the present embodiment include: synthetic wax such as polypropylene and polyethylene; petroleum wax such as paraffin wax and derivative thereof and microcrystalline wax and derivative thereof; denatured wax of the petroleum wax; and botanical wax such as carnauba wax, rice wax, and candelilla wax. By causing the toner to contain the release agent, it is possible to increase releasability of the toner from a fixing roller or a fixing belt, thereby preventing high temperature/low temperature offset when fixing the toner. The amount of the release agent to be added is not particularly limited. In general, 1-5 parts by weight of the release agent is added to 100 parts by weight of the binder resin.

(f) Carrier

The toner of the present embodiment is used as a component contained in two-component developer and therefore is mixed with a carrier. In general, a toner and a carrier are mixed with each other in such a manner that 3-15 parts by weight of the toner is mixed with 100 parts by weight of the carrier and the mixture is stirred by a mixer such as a Nauta mixer. Thus, the two-component developer is prepared. However, usage of the toner of the present embodiment is not limited to the two-component developer, and may be used in one-component developer.

The carrier is not particularly limited, but is preferably a magnetic substance of 20-100 μm in a volume average particle size. When the particle size of the carrier is too small, the carrier moves from a developing roller to a photosensitive drum at a time of development, resulting in white spots in an obtained image. When the particle size of the carrier is too large, reproducibility of dots drops, resulting in a rough image. Accordingly, it is further preferable that the volume average particle size of the carrier ranges from 30 to 60 μm. The volume average particle size of the carrier was measured by a laser diffraction particle size analyzer HELOS (manufactured by SYMPATEC) and a dry disperser RODES (manufactured by SYMPATEC) under a dispersive pressure of 3.0 bar.

Lower saturation magnetization allows a magnetic brush in contact with a photosensitive drum to be softer, which provides an image true to an electrostatic latent image. However, when the saturation magnetization is too low, the carrier attaches to the surface of the photosensitive drum, which is more likely to cause white spots. In contrast, when the saturation magnetization is too high, the magnetic brush gets too hard, which makes it difficult to obtain an image true to the electrostatic latent image. Accordingly, it is preferable that the saturation magnetization of the carrier ranges from 30 to 100 emu/g.

In general, a coated carrier obtained by coating the surfaces of magnetic core particles with a coating layer is frequently used. The core particles may be publicly known magnetic particles, and preferably are ferrite particles in terms of a charging property and durability. The ferrite particles may be publicly known ones. Examples of the ferrite particles include zinc ferrite, nickel ferrite, copper ferrite, nickel-zinc ferrite, manganese-magnesium ferrite, copper-magnesium ferrite, manganese-zinc ferrite, and manganese-copper-zinc ferrite.

These ferrite particles can be prepared through a publicly known method. For example, ferrite raw materials such as $Fe_2O_3$ and $Mg(OH)_2$ are mixed with each other, and the mixed powder is heated and calcinated by a heating furnace. The calcinated resultant is cooled down and then pulverized by a vibrating mill so as to be particles of substantially 1 μm. A dispersing agent and water is added to the powder obtained by the pulverization so as to prepare slurry. The slurry is wet-pulverized by a wet-type ball mill, the resulting suspension liquid is granulated and dried by a spray drier so as to obtain ferrite particles.

The coating material may be a publicly known resin material such as acrylic resin and silicone resin. The coated carrier coated with silicone resin is particularly preferable since a boron compound is less likely to be spent (attach) on the surface of the coated carrier and the coated carrier keeps an ability to charge a toner over a long time.

The silicone resin may be a publicly known one such as: silicone varnish (product name: TSR115, TSR114, TSR102, TSR103, YR3061, TSR110, TSR116, TSR117, TSR108, TSR109, TSR180, TSR181, TSR187, TSR144, TSR165 etc. (manufactured by Shin-Etsu Chemical Co., Ltd.)) and (product name: KR271, KR272, KR275, KR280, KR282, KR267, KR269, KR211, KR212 etc. (manufactured by TOSHIBA CORPORATION)); alkyd denatured silicone varnish (product name: TSR184, TSR185, etc. (manufactured by TOSHIBA CORPORATION)); epoxy denatured silicone varnish (product name: TSR194, YS54, etc. (manufactured by TOSHIBA CORPORATION); polyester denatured silicone varnish (product name: TSR187 etc. (manufactured by TOSHIBA CORPORATION)); acryl denatured silicone varnish (product name: TSR170, TSR171, etc. (manufactured by TOSHIBA CORPORATION)); urethane denatured silicone varnish (product name: TSR175 etc. (manufactured by TOSHIBA CORPORATION)); and reactive silicone resin (product name: KA1008, KBE1003, KBC1003, KBM303, KBM403, KBM503, KBM602, KBM603 etc. (manufactured by Shin-Etsu Chemical Co., Ltd.).

An electrically conductive material is added to the coating material in order to control volume resistivity of carrier. Examples of the electrically conductive material include silicon oxide, alumina, carbon black, graphite, zinc oxide, titanium black, iron oxide, titanium oxide, tin oxide, potassium titanate, calcium titanate, aluminum borate, magnesium oxide, barium sulfate, and calcium carbonate. Among them, carbon black is preferable in terms of stability in preparation, low cost, and low electric resistance. The kinds of carbon black are not particularly limited but carbon black whose amount of supplied DBP (dibutylphthalate) ranging from 90 to 170 ml/100 g is preferable since such carbon black has high stability in preparation. Further, carbon black of 50 nm in a primary particle size is particularly preferable since such carbon black has a high dispersing property. The electrically conductive materials may be used singularly or two or more of them may be used in combination. The amount of the electrically conductive material to be used preferably ranges from 0.1 to 20 parts by weight with respect to 100 parts by weight of the coating material.

A publicly known method may be employed to cause the coating material to coat the carrier particles. Examples of the method include: an immersion method for immersing carrier particles in an organic solvent solution of the coating material; a spray method for spraying an organic solvent solution of the coating material to the carrier particles; a fluid bed method for spraying an organic solvent solution of the coating material to the carrier particles while suspending the carrier particles with use of fluidized air; and a kneader coater method for mixing the carrier particles and an organic solvent solution of the coating material in a kneader coater and removing the solution. In this case, to the organic solvent solution of the coating material is added an electrically conductive material for controlling resistance as well as the coating material.

The external additive of the present embodiment for toner use and the toner of the present embodiment are preferably applicable to developer used in an electrophotographic multifunction printer, a copying machine, a printer, and a facsimile device.

The inventors of the present invention diligently studied the cause of attachment of foreign matters to a discharging electrode of a charger, and considered the cause to be as follows.

In an external additive included in a toner, dimethylsilyl groups are introduced to the surfaces of particles (the surfaces of particles are subjected to a hydrophobizing process) in order to prevent photographic fog when forming an image. In the hydrophobizing process, octamethylcyclotetrasiloxane is produced (in some cases, a coupling agent for the hydrophobizing process contains octamethylcyclotetrasiloxane).

It is supposed that octamethylcyclotetrasiloxane remains in the external additive in such a manner as to be attached to the surface of the external additive. When a toner including the external additive to which octamethylcyclotetrasiloxane is attached is used in an image forming apparatus, octamethylcyclotetrasiloxane volatilizes gradually from the toner and attaches to the discharging electrode of the charger. Octamethylcyclotetrasiloxane at the discharging electrode chemically changes to a non-volatile silicon compound, which attaches to the discharging electrode as a foreign matter.

With respect to the problem, the inventors of the present invention found that even in a case where a main component of an external additive is oxide fine particles in which dimethylsilyl groups are introduced to surfaces thereof, when the amount of octamethylcyclotetrasiloxane volatilizing in the first volatilizing test on the external additive is 0.2 μg or less, octamethylcyclotetrasiloxane hardly volatilizes from the external additive when performing an image forming process with use of the toner containing the external additive.

That is, the external additive of the present embodiment is an external additive, containing oxide fine particles as a main component, added to a toner used in an electrophotographic image forming apparatus, dimethylsilyl groups being introduced to surfaces of the oxide fine particles, and an amount of octamethylcyclotetrasiloxane volatilizing in a first volatilizing test being 0.2 μg or less. With the arrangements as described above, octamethylcyclotetrasiloxane hardly volatilizes from the external additive when performing the image forming process. Consequently, it is possible to prevent foreign matters from attaching to a discharging electrode, resulting in a high-quality image without black streaks.

The first volatilizing test is a test in which 2 g of the external additive is contained in a sealing container and the inside of the sealing container is kept at 120° C. for 10 minutes so that octamethylcyclotetrasiloxane volatilizes from the external additive.

Further, it is preferable to arrange the external additive of the present embodiment so that the oxide fine particles are made of silicon oxide. This is because fine particles made of silicon oxide have an excellent insulating property and therefore addition of the external additive to a toner allows the toner to have an excellent insulating property, which prevents a charging amount from dropping, thereby preventing photographic fog and undesirable concentration of an image.

Further, it is preferable to arrange the external additive of the present embodiment so that a number average particle size ranges from 7 nm to 30 nm. This is because addition of the external additive whose number average particle size ranging from 7 nm to 30 nm to a toner allows the toner to have a good fixing property, a good charging property, and a good fluidity, resulting in a high-quality image.

Further, the inventors of the present invention found that even in a case of using a toner containing an external additive whose main component is oxide fine particles in which dimethylsilyl groups are introduced to surfaces thereof, when the amount of octamethylcyclotetrasiloxane volatilizing in the second volatilizing test on the toner is 0.02 μg or less, octamethylcyclotetrasiloxane hardly volatilizes from the external additive when performing an image forming process with use of the toner containing the external additive.

That is, the toner of the present embodiment is a toner, containing an external additive that contains oxide fine particles as a main component, used in an electrophotographic image forming apparatus, dimethylsilyl groups being introduced to surfaces of the oxide fine particles, and the amount of octamethylcyclotetrasiloxane volatilizing in a second volatilizing test being 0.02 μg or less. With the arrangement, as described above, octamethylcyclotetrasiloxane hardly volatilizes from the toner when performing the image forming process. Consequently, it is possible to prevent foreign matters from attaching to a discharging electrode, resulting in a high-quality image without black streaks.

The second volatilizing test is a test in which 10 g of the toner is contained in a sealing container and the inside of the sealing container is kept at 100° C. for 30 minutes so that octamethylcyclotetrasiloxane volatilizes from the external additive.

Further, it is preferable to arrange the toner of the present embodiment so that the oxide fine particles are made of silicon oxide. This is because fine particles made of silicon oxide have an excellent insulating property and therefore addition of the external additive to a toner allows the toner to have an excellent insulating property, which prevents a charging amount from dropping, thereby preventing photographic fog and undesirable concentration of an image.

Further, it is preferable to arrange the toner of the present embodiment so that a weight percentage concentration of the external additive ranges from 0.5 wt % to 3 wt %. The arrangement allows the toner to have a good fixing property, a good charging property, and a good fluidity, resulting in a high-quality image.

Further, the image forming apparatus of the present embodiment is an image forming apparatus based on an electrophotographic method, including: a photoreceptor; a discharging electrode for charging the photoreceptor by giving electric charges to the photoreceptor; an exposure section for exposing the charged photoreceptor so as to form a latent image on the photoreceptor; and a developing section for supplying developer to the photoreceptor on which the latent image is formed, so as to develop the latent image, the developer containing the toner of the present embodiment. With the image forming apparatus of the present embodiment, it is possible to prevent foreign matters from attaching to the discharging electrode, resulting in a high-quality image without black streaks.

Further, it is preferable to arrange the image forming apparatus of the present embodiment so that the discharging electrode is a plate-shaped electrode having a plurality of protrusions. With the arrangement, it is possible to provide an image forming apparatus which is capable of preventing more amount of ozone than an image forming apparatus having a tungsten wire as a discharging electrode, and which is environment-friendly.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An external additive, containing oxide fine particles as a main component, added to a toner used in an electrophotographic image forming apparatus, dimethylsilyl groups being introduced to surfaces of the oxide fine particles, and the oxide fine particles being subjected to a heating treatment after the dimethylsilyl groups have been introduced to the surfaces of the oxide fine particles, so that an amount of octamethylcyclotetrasiloxane volatilizing in a first volatilizing test is 0.2 μg or less, the first volatilizing test being performed in such a manner that 2 g of the external additive whose oxide fine particles have been subjected to the heating treatment is contained in a sealing container and an inside of the sealing container is kept at 120° C. for 10 minutes so that octamethylcyclotetrasiloxane volatilizes from the external additive.

2. The external additive as set forth in claim 1, wherein the oxide fine particles are made of silicon oxide.

3. The external additive as set forth in claim 1, wherein a number average particle size ranges from 7 nm to 30 nm.

4. The additive as set forth in claim 1, wherein the heating treatment is carried out in such a manner that the oxide fine particles to the surface of which the dimethylsilyl groups have been introduced are caused to flow for 30-60 minutes in a stirring tank to which air at 100-200° C. is sent.

5. A toner, containing an external additive that contains oxide fine particles as a main component, used in an electrophotographic image forming apparatus, dimethylsilyl groups being introduced to surfaces of the oxide fine particles, and the oxide fine particles being subjected to a heating treatment after the dimethylsilyl groups have been introduced to the surfaces of the oxide fine particles, so that an amount of octamethylcyclotetrasiloxane volatilizing in a second volatilizing test is 0.02 μg or less, the second volatilizing test being performed in such a manner that 10 g of the toner containing the external additive whose oxide fine particles have been subjected to the heating treatment is contained in a sealing container and an inside of the sealing container is kept at 100° C. for 30 minutes so that octamethylcyclotetrasiloxane volatilizes from the toner.

6. The toner as set forth in claim 5, wherein the oxide fine particles are made of silicon oxide.

7. The toner as set forth in claim 5, wherein a weight percentage concentration of the external additive ranges from 0.5 wt % to 3 wt %.

8. The toner as set forth in claim 5, wherein the heating treatment is carried out in such a manner that the oxide fine particles to the surface of which the dimethylsilyl groups have been introduced are caused to flow for 30-60 minutes in a stirring tank to which air at 100-200° C. is sent.

9. An image forming apparatus based on an electrophotographic method, comprising:

a photoreceptor;

a discharging electrode for charging the photoreceptor by giving electric charges to the photoreceptor;

an exposure section for exposing the charged photoreceptor so as to form a latent image on the photoreceptor; and a developing section for supplying developer to the photoreceptor on which the latent image is formed, so as to develop the latent image, the developer containing the toner as set forth in claim 5.

10. The image forming apparatus as set forth in claim 9, wherein the discharging electrode is a plate-shaped electrode having a plurality of protrusions.

11. A method for producing an external additive which contains oxide fine particles as a main component and is added to a toner used in an electrophotographic image forming apparatus, the method comprising the steps of:

introducing dimethylsilyl groups to surfaces of the oxide fine particles; and thereafter subjecting the oxide fine particles to a heating treatment so that an amount of octamethylcyclotetrasiloxane volatilizing in a first volatilizing test is 0.2 μg or less, the first volatilizing test being performed in such a manner that 2 g of the external additive whose oxide fine particles have been subjected to the heating treatment is contained in a sealing container and an inside of the sealing container is kept at 120° C. for 10 minutes so that octamethylcyclotetrasiloxane volatilizes from the external additive.

12. The method as set forth in claim 11, wherein the heating treatment is carried out in such a manner that the oxide fine particles to the surface of which the dimethylsilyl groups have been introduced are caused to flow for 30-60 minutes in a stirring tank to which air at 100-200° C. is sent.

13. a method of producing a toner which contains an external additive containing oxide fine particles as a main component and is used in an electrophotographic image forming apparatus, the method comprising the steps of:

introducing dimethylsilyl groups to surfaces of the oxide fine particles; and thereafter subjecting the oxide fine particles to a heating treatment, so that an amount of octamethylcyclotetrasiloxane volatilizing in a second volatilizing test is 0.02 μg or less, the second volatilizing test being performed in such a manner that 10 g of the toner containing the external additive whose oxide fine particles have been subjected to the heating treatment is contained in a sealing container and an inside of the sealing container is kept at 100° C. for 30 minutes so that octamethylcyclotetrasiloxane volatilizes from the toner.

14. The method as set forth in claim 13 wherein the heating treatment is carried out in such a manner that the oxide fine particles to the surface of which the dimethylsilyl groups have been introduced are caused to flow for 30-60 minutes in a stirring tank to which air at 100-200° C. is sent.

* * * * *